United States Patent [19]

Crane et al.

[11] 4,187,507

[45] Feb. 5, 1980

[54] MULTIPLE BEAM ANTENNA ARRAY

[75] Inventors: Patrick E. Crane, Tampa; Robert E. Lazarchik, Largo, both of Fla.; Arthur H. Schaufelberger, deceased, late of New Port Richey, Fla., by Ruth L. Schaufelberger, administratrix

[73] Assignee: Sperry Rand Corporation, New York, N.Y.

[21] Appl. No.: 951,216

[22] Filed: Oct. 13, 1978

[51] Int. Cl.[2] ..... H01Q 19/06; H01Q 13/00; H01Q 3/26

[52] U.S. Cl. ..... 343/754; 343/780; 343/854

[58] Field of Search ..... 343/753, 754, 755, 780, 343/854

[56] References Cited

U.S. PATENT DOCUMENTS

| | | | |
|---|---|---|---|
| 2,585,562 | 2/1952 | Lewis | 343/780 |
| 3,170,158 | 2/1965 | Rotman | 343/754 |
| 4,010,471 | 3/1977 | Smith | 343/854 |
| 4,087,822 | 5/1978 | Maybell et al. | 343/854 |

*Primary Examiner*—Paul L. Gensler
*Assistant Examiner*—Harry E. Barlow
*Attorney, Agent, or Firm*—Howard P. Terry

[57] ABSTRACT

The multiple beam, short wave planar antenna array system, which simultaneously exhibits low loss, low side lobe levels, high efficiency, and low volume in a design affording independent control of the E and H plane radiation pattern shapes is particularly applicable in microwave radiometric systems such as airborne mapping systems. The antenna system generates symmetrical, matching narrow pencil beam sensitivity patterns by using symmetrically spaced sectorial receiver horns fed energy through a hyperbolic dielectric lens, the horn array and lens residing in a $TE_{01}$ mode parallel plate guide, the lens being illuminated by signals collected by a broad wall slotted wave guide array supplied with a thin, planar sheet radome mounted on the energy receiving face of the array.

10 Claims, 6 Drawing Figures

MULTIPLE BEAM ANTENNA ARRAY

BACKGROUND OF THE INVENTION

1. Field of the Invention

The invention pertains to antenna array systems of the type in which a plurality of cooperating antenna elements provides means for selectively generating multiple radiation or reception patterns and more particularly relates to such antenna arrays that are particularly adaptable to use in airborne microwave radiometric systems of the search or mapping kind.

2. Description of the Prior Art

Because of inherent characteristics of antenna systems employed in the prior art, it has been difficult to provide an antenna array particularly adapted for continuous wide frequency band scanning or viewing of terrain or ocean areas for surveying or for surveillance purposes, such as for warning of the presence of dangerous ice or iceberg conditions. Mapping or surveillance passive radiometric systems require a wide operational band width. Signal amplitudes being small and object-identifying gradients also small, very low loss, microwave (especially millimeter wave length) systems are desired. Prior art proposals have not been fully successful, in that low loss and sufficient band width have not generally been attained. Where prior art antennas view a sufficiently wide sector, serious deterioration of the beam shape and width is observed, especially at the extremes of the sector scanned or viewed. Beam shape deterioration and wide variation in the location and amplitude of undesired side lobes have been present, in part due to lack of uniform energy phase fronts in various parts of the antenna systems.

A known prior approach to the problem is that described in the A. H. Schaufelberger U.S. Pat. No. 3,697,988 for a "Multiple Beam Array Antenna," issued Oct. 10, 1972 and assigned to Sperry Rand Corporation. This device is a multi-element antenna array system adapted to operation in either passive or active electronic systems and having an array antenna conforming to the cylindrical contour of an airborne vehicle. Elements of the array, such as slotted transmission line antennas in side-by-side cooperative relation, provide collimation in one plane of the radially extending antenna patterns. According to the prior invention, a plurality of such radially directive patterns may be simultaneously formed or one or more such patterns may be angularly scanned over a wide sector. The pattern generation mechanism employs a geodesic parallel plate energy guiding system which determines the activities of the antenna patterns and also additionally collimates them in a second plane.

However, the prior device by its inherent nature has proven to be unacceptably large for certain applications, requiring a volume not at all compatible with the small size of certain supersonic vehicles. In addition, the prior antenna device requires the use of a geodesic lens formed by a complex parallel plate conformal horn arrangement difficult and expensive to fabricate and to assemble. The simple flat parallel plate collimator of the present invention is much less expensive and less difficult to manufacture. Furthermore, the system aperture of the prior art device requires expansion to permit scanning, while the present invention makes efficient use of the available aperture and requires no additional aperture to accommodate scanning.

SUMMARY OF THE INVENTION

The novel high frequency antenna system generates symmetrically disposed matching narrow coplanar pencil beam sensitivity patterns and serves as an array useful in microwave radiometric systems of the search or surveying kind. The short wave antenna overcomes the difficulties of the prior art by employing symmetrically spaced sectorial receiver horns fed electromagnetic energy through a planar-hyperbolic lens, the horn array and lens being disposed in a parallel plate wave guide and the lens being illuminated by signals collected by a broad wall slotted wave guide array having a thin radome sheet at its energy receiving face.

DESCRIPTION OF THE PREFERRED EMBODIMENTS

The invention will be discussed primarily in forms most suitable for use, for example, in passive, high frequency radiometric receiver systems mounted rigidly in an airborne fuselage. It will be understood, however, that the invention has utility in other types of high frequency systems, including systems such as active radar and communication systems. Such versatility will be seen to be inherent in the invention, since the electromagnetic energy reciprocity propagation law is obeyed by all of its components and, therefore, by the operatively connected sum of them.

Figure 1:
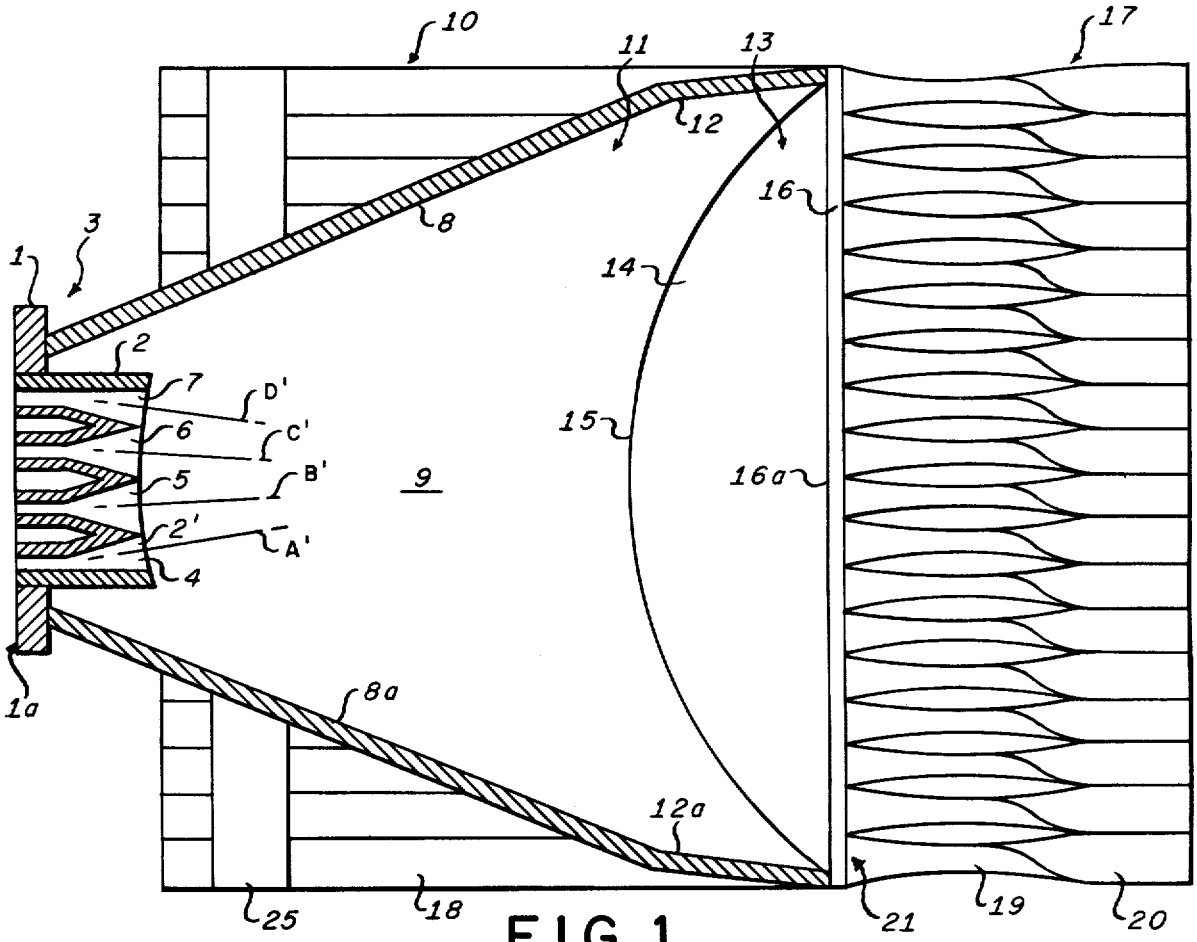
FIG. 1 is a plan view in partial cross section of the antenna system.
Figure 2:
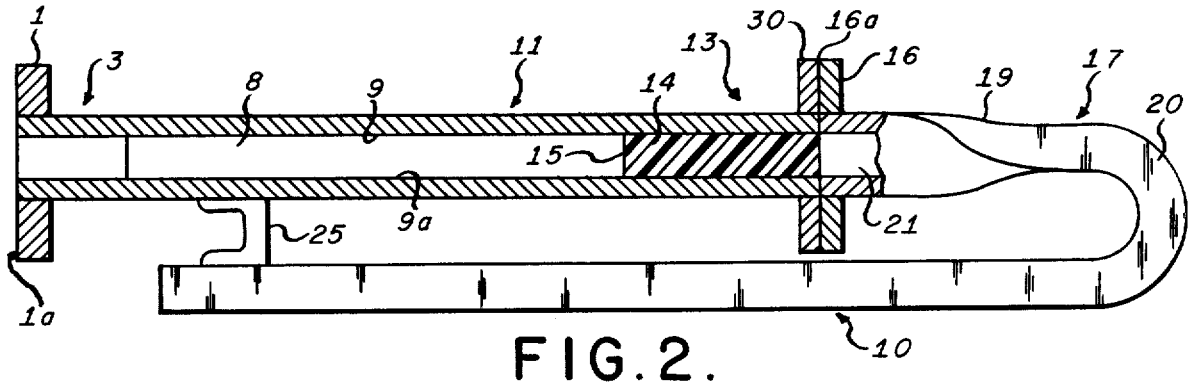
FIG. 2 is an elevation view in partial cross section of the FIG. 1 structure.

The antenna system is most easily understood by considering it to be composed of two major subassemblies, a sectored horn lens structure contained between 1*a* and 16*a* of FIGS. 1 and 2, and a travelling wave antenna array 10 of wave guide transmission lines which attaches at plane 16*a* to the horn lens structure. The horn lens structure acts to transform point sources present at plane 1*a* into line sources at plane 16*a*, each having a linear phase gradient associated with the offset of the point source from the axis of symmetry of the system. The travelling wave antenna array 10 acts to transform the line sources present at plane 16*a* into area sources across the slotted face of the array which, in turn, causes the formation of the radiated antenna beams in the secondary pattern. In order to accomplish these functions within the requirements of the associated radio system for polarization orientation, available aperture size, electromagnetic energy losses, side lobe levels, and radiation pattern symmetry, it is necessary that the two sub-systems interact in a unique and precise fashion.

Figure 3:
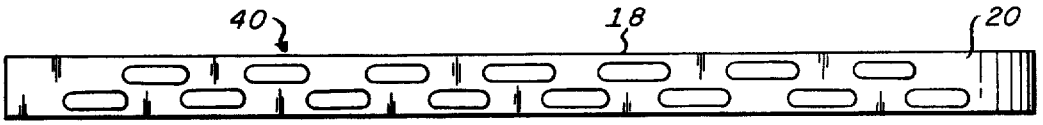
FIG. 3 is a view of the energy receiving face of one of the slotted wave guides of the array of FIGS. 1 and 2.

In general, the array 10 is a broad wall travelling wave array using conventional longitudinal resonant shunt slot openings as at 40 in FIG. 3 for producing radiation into space which is linearly polarized with the electric field vector E perpendicular to the longitudinal axis of the typical wave guide 18. The array 10 includes a sufficient number of such radiating wave guides 18 to provide the desired total aperture.

The novel energy sectorial horn lens processing system 17, 13, 11, 3 associated with the transmission line array 10 extends above and in generally parallel relation with the latter from the end of array 10 remote from frame element 25. A first portion 17 of the energy processing system includes a plurality of arcuate couplings 20 each joined to one of an equal plurality of 90° twist wave guiding elements such as the typical 90° twist 19. The 90° twists 19 and the 180° E plane bends 20 cooperate in converting the propagating energy to the proper wave guide mode for coupling directly to the broad wall array 10, advantageously eliminating the need for a polarization grating. Each 90° twist 19 ends in an aperture lying in a common plane at 16*a* which, in turn, in an interface plane between flanges 16 and 30 (FIG. 2) useful in fastening the two major parts of the antenna system together, as by conventional fasteners (not shown). This array of input horns 21 provides a suitable transition from the standard dimensions of the wave guide from which broad wall array 18 is constructed to the dimensions of the parallel plate system 13, 11, next to be discussed. The arrangement thus far described serves to deliver energy collected by array 10 so that it arrives at plane 16*a* with a substantially uniform phase front.

At plane 16*a*, there is disposed the planar-convex dielectric lens 14 of lens section 13, having its planar edge in the plane 16*a* of flange 16. The cylindrical lens 14 converts the nearly uniform phase front incident thereon at plane 16*a* into the curvate phase front normally characteristic of each horn aperture 4, 5, 6, 7 of horn array 3. Lens 14 has a hyperbolic cylindric convex surface 15 opposite the planar surface of plane 16*a*. The hyperbolic shape is selected because it generates a plane wave front at plane 16*a* in such a way that the number of wave guides need not be increased to maintain beam width in the E plane when using horns such as 4, 5, 6, and 7 of FIG. 1, which are offset from the lens axis and result in a scanned beam in the E plane. Lens 14 is composed of a dielectric material such as a conventional cross-linked polystyrene material, for example, having a very low loss tangent. One suitable material is a thermosetting material having generally the same electrical characteristics as conventional polystyrene, but is much stronger mechanically, not crazing readily as does more ordinary polystyrene or the like. The material is readily available on the market under the trade name Rexolite.

Lens 13 has a focal length of about three inches for a typical system operating in the K band and is disposed in a parallel plate horn section 11 having extensive closely spaced parallel upper and lower conducting walls 9, 9*a* bounded at the edges thereof by conducting narrow vertical walls 8, 8*a* which form a flared parallel plate horn having an aperture at plane 16*a*. Horn array 3 and lens 13 provide a medium through which the energy wave fronts found at plane 16*a* and modified by lens 14 are matched to and focussed within one or another of the horns of horn array 3. Horn array 3 includes a plurality of small horns (four, for example) having apertures at 4, 5, 6, 7 facing the hyperbolic surface 15 of lens 14, each such horn having an axis such as axis A', B', C', D' directed at a focal point lying on the face 2' at which the energy from an appropriately tilted plane wave front impinging on plane 16*a* is focussed. Each horn of horn array 3 flares in the E plane only. The combination of the structures of dielectric lens 14, parallel plate guide horn 11, and the plurality of horns 4, 5, 6, and 7 operates with the E field vector parallel to the parallel plates 9, 9*a* of the parallel plate horn 11. In this manner, any impedance mismatch at interface 16*a* between lens 14 and horn array 21 is minimized. A grating composed of parallel plates, such as the walls of the horn array 21, presents an impedance primarily determined by the spacing between the conductive boundaries which are parallel to the E field of the propagating energy. In this case, this dimension is identical on either side of plane 16*a*, thereby presenting a minimal mismatch at plane 16*a*. The dielectric lens 13 may include a quarter wave matching structure at its planar edge, further to reduce the mismatch to the horn array 21. This matching structure may be made in the conventional manner by cutting grooves in the planar lens surfaces. The design of lens 14 is preferably chosen for a ratio of focal length-to-maximum lens dimension (D in FIG. 6) of 0.5, which makes it easily possible to adjust the disposition of horns 4, 5, 6, 7 by ordinary mechanical means (not shown) to achieve the desired lens illumination and also allows precision adjustment of the shapes of the individual antenna patterns. In the medium of the dielectric lens 14, the index of refraction is determined, not only by the dielectric constant of the propagation medium, but also by the spacing of parallel plates 9, 9*a*.

Figure 4:
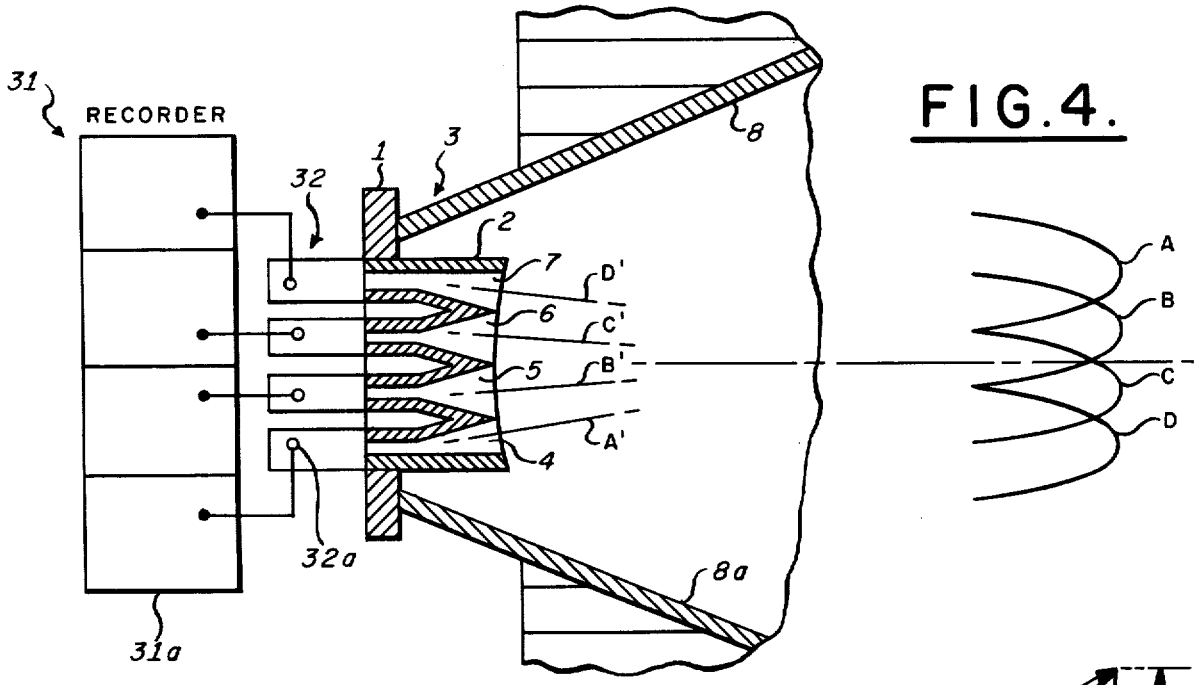
FIG. 4 is a fragmentary view in partial cross section similar to part of FIG. 1 but showing receptivity patterns and connections to a receiver device corresponding to those patterns.

FIG. 4 illustrates one manner in which the invention may be used in a radiometric application. The four fanned antenna patterns A, B, C, D represent sensitivity patterns of the novel antenna when used as a receiver antenna. It is seen that any one of the several patterns A, B, C, D, when excited by a suitable source, will propagate energy which is then processed by sections 17, 13, 11, 3. Each of the plurality of horns 4, 5, 6, and 7 is provided with a sensor, such as the conventional crystal detector 32A associated with a wave guide section extending from horn 4, for example. Each of the detectors of the array 32 is coupled to respective utilization means which may take the form of measuring or display devices such as a recorder unit 31A of the array of recorders 31, for example. The several outputs of the detector array 32 may be applied to any well known type of radiometric utilization device, such as to the multichannel recorder 31, wherein separate records of the detected signals may be stored on a medium such as paper. The medium may, for instance, be driven past recorder pens at a rate which is a function of time, integrated air speed, or actual distance travelled as derived from a loran navigational receiver system or other aid to navigation. The outputs of the several detectors may also be displayed for visual interpretation, if desired, as in the instance of iceberg detection. A feature of the system in radiometric application lies in the fact that it may be used as a wide-open system in which data from all receiver channels is applied for search alarm purposes, or with a system instantaneously recording data from separate channels simultaneously, or both functions can operate at the same time.

In this manner, the invention features, for example, four symmetric, precisely matched, four degree wide reception patterns at 3 dB. points overlapping at 6 dB. points by means of the desirably low volume lens-broad wall array combination. Each of the four symmetrically spaced sectorial horns 4, 5, 6, 7, coupled through the planar-hyperbolic lens 14 via the $TE_{01}$ mode parallel plate wave guide horn 11, is associated with one receptivity pattern. Four separate sealed wave guide outputs are conveniently mated with corresponding separate receivers, such as those of multiple recorder 31. The configuration provides beneficially low side lobes and low loss characteristics without undesired frequency dispersion. It therefore provides maximum use of the narrow dimension of the available antenna entrance aperture. The orientation of the long dimension of the aperture compensates for any frequency dispersion inherent in the wave propagating system, while maintaining the space polarization of the patterns. If desired, a thin sheet of radome material may be flush-mounted in the conventional manner in moisture sealed relation on the active face of wave guide array 10 with negligible pattern distortion.

With more particular respect to the design and construction of the slotted antenna array 10, it consists in one example of a series of eighteen parallel wave guides formed of 6061 aluminum alloy with longitudinal slots cut, as at 40, through their broad walls. The individual guides, after the slots are formed, are annealed to receive a 180° E-plane bend 20 and a 90° twist 19 before forming horn 21. The sectorial horns at 21 are constructed by broadening the narrow wave guide wall. After each such individual array element 18 is formed, they are aligned and dip brazed, together forming an integral rigid assembly. After heat treating, the entire assembly may be supplied with a conventional chromate corrosion protection treatment.

The coplanar slotted array, in one form of the invention, has resonant slots of the longitudinal shunt type and is designed for primary radiation angle of 87.5° from the end fire direction in the H plane. The H plane radiation angle is a function of slot spacing and frequency and is controlled by adjusting the phase lag between slots. The array factor for a broad side array of n sources is given by the relation:

$$f(x)=(\sin n\,x)/(n \sin x) \tag{1}$$

where:

$x=\pi d \sin\theta+\Delta/2$, $\Delta=\pi-2\pi d/\lambda_g$=phase lag d=separation between elements (the separation, along the longitudinal axis of the guides, between consecutive slots), $\lambda_g$=guide wave length at center frequency, and $\theta$=radiation angle with respect to the direction normal to the array. The term array factor is, as usual, defined as a function which, when multipled by the radiation pattern produced by a single element of an array, produces a function describing the radiation pattern for the entire array. The angle $\theta$ between the beam axis and the normal direction is obtained by setting x=0 and solving for $\theta$:

$$\theta=(\pi d/\lambda)\sin\theta+\pi-2\pi d/\lambda_g \tag{2}$$

so that:

$$\theta=\arcsin[\lambda/\lambda_g-\lambda/2d] \tag{3}$$

Thus, the radiation angle $\theta$ is a function of slot spacing d and frequency. This dependence on frequency causes a beam dispersion giving a resultant beam width of:

$$\theta_R=[1+0.15\,(\text{band width/beam width})^2]\ \text{angular beam width}$$

where the required band width=3.43 percent, and the design beam width≈3.6° so that:

$\theta_R$=4.08° and dispersion≈13 percent. Using the horn lens combination, frequency dispersion is negligible in the E plane; but as shown above for a required band width of 3.43 percent (1200 MHz/35,000 MHz) dispersion is on the order of 13 percent in the H plane. This means that the H plane aperture dimension must be selected for 3.6° beam width at center frequency. Utilization of the broad wall array satisfies the requirement for polarization to be perpendicular to the longitudinal axis of the craft and the need to use the larger dimension of the available aperture to compensate for frequency dispersion.

Selection of the illumination taper for the antenna system is based upon optimum use of the antenna aperture for passive radiometric applications. This taper is separately controllable, according to the invention, in the E-plane, by varying the design of the horn array 3 and, in the H-plane, by the varying design of the resonant slot distribution and slot configuration. This feature provides two important advantages of the invention: first, the two planes may readily be controlled or adjusted independently of each other and, second, each radiation pattern can be adjusted individually for symmetry and angular displacement.

High gain may be achieved by use of a Dolph-Tchebyscheff illumination taper. This taper gives the maximum main lobe gain possible for a given side lobe level and aperture size; however, all side lobes have the same amplitude even out to 90° from the main lobe center. This means that even though the aperture efficiency is high, the main beam efficiency is low. Main beam efficiency is defined as the percentage of radiated power in the main lobe compared to the total radiated power including the side lobes and back lobes. This term differs from the term aperture efficiency, which relates the antenna gain to the theoretical maximum gain for a given aperture size. The theoretical maximum aperture efficiency occurs for a uniformly illuminated aperture with no losses. For radiometer purposes, a uniformly illuminated aperture, even if attainable, would be undesirable because of the associated high side lobes (13.5 dB. for rectangular apertures and 17 dB. for circular apertures). The consequence of these high side lobes would be very low main beam efficiency. Therefore, high aperture efficiency is incompatible with high main beam efficiency, and main beam efficiency is important to radiometers because only responses from the main beam are desired. With this in mind, the following illumination taper is selected:

$$P(x)=U+(1-U)\cos^2\left[\left(\frac{x}{a}\right)\left(\frac{\pi}{2}\right)\right] \tag{4}$$

where

U=(percent uniform illumination)/100, and:

a=(aperture width)/2.

Figure 5:
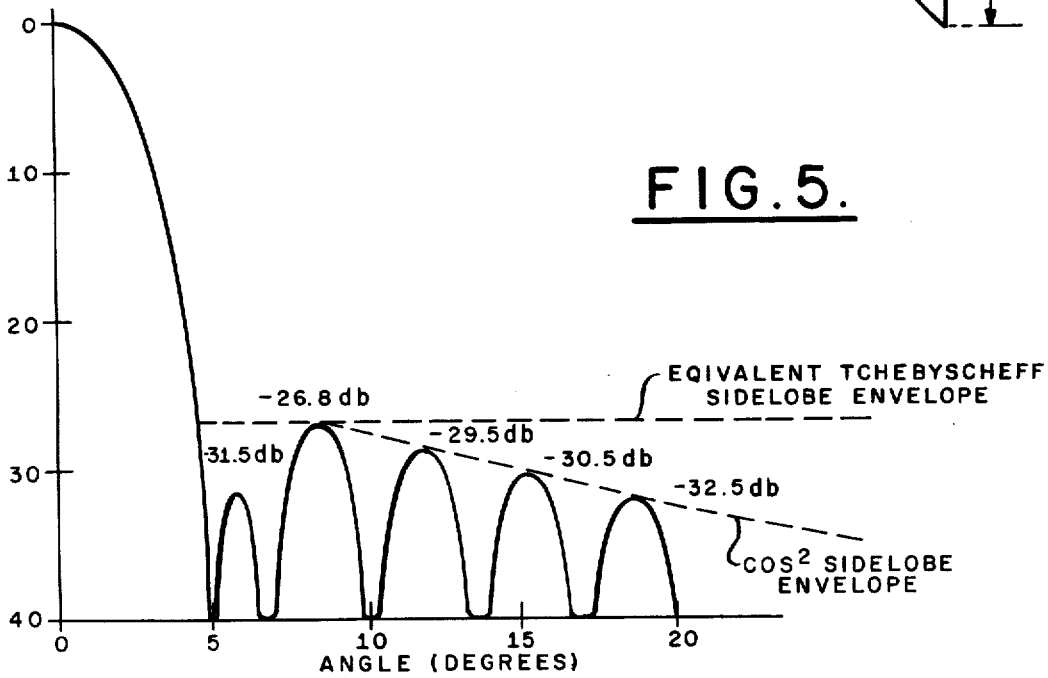
FIG. 5 contains a graph useful in explaining the operation of the invention.

A plot of the resultant radiation or receptivity pattern along with the equivalent Dolph-Tchebyscheff side lobe envelope is shown in FIG. 5. Note that the side lobe levels desirably fall off after the second side lobe as compared to the Dolph-Tchebyscheff side lobe envelope for the same maximum side lobe level.

Figure 6:
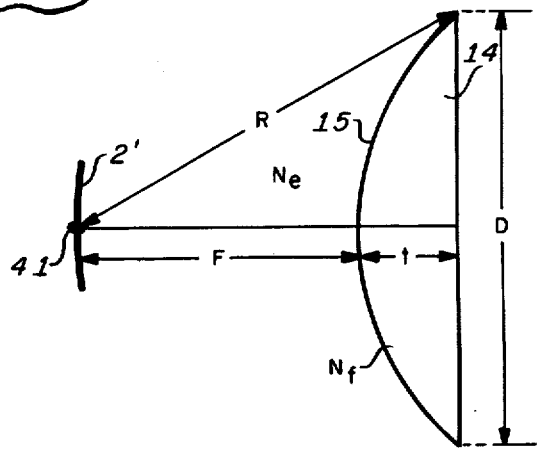
FIG. 6 is a drawing of the lens 14 of FIG. 1 useful in explaining its design.

FIG. 6 permits more detailed consideration of the design of the dielectric lens 14. Here, t is the maximum thickness of lens 14, F the focal distance of focal point 41 at horn face 2' with respect to the locus of that maximum, $N_e$ the index or refraction for microwave energy within the air filled portion of parallel plate guide 9, 9a, $N_f$ the refractive index where guide 9, 9a is occupied by lens 14, and D is the maximum dimension of the lens. Accordingly, $$R^2=(F+t)^2+(D/2)^2 \quad (5)$$

also:

$$RN_e=FN_e+N_f(t) \quad (6)$$

and $$N_e=(1-(\lambda o/2a)^2)^{\frac{1}{2}} \quad (7)$$

where a is the distance between broad walls 9,9a. Equations 5, 6 and 7 may readily be combined to yield:

$$(N_f^2-N_e^2)t^2+2F(N_eN_f-N_e^2)t-(D/2)N_e)^2=0 \quad (8)$$

The value of t is readily solved from equation (8). In a typical experimental lens 14, $\lambda_o=0.34$ inches, $a=0.32$ inches, $F=3.00$ inches, $N_f=1.48$ inches, and $N_e=0.80$ inches, so that t, the maximum thickness of lens 14, is about 1.15 inches. Since F, t, and D are now known, the locus of hyperbolic face 15 is uniquely determined.

Accordingly, the novel low cost antenna overcomes the problems of the prior art and features several additional advantages. Viewing the face of array 10, the field distribution in the E-plane is controlled solely by the shape of the patterns of the four horns 4, 5, 6, 7. On the other hand, the field distribution in the H-plane is controlled independently by the slots of array 10. These structures being independent of each other independent control of the field distribution in the two planes is assured. The E-plane pattern symmetry and alignment are easily achieved by adjustment of the positions and apertures of horns 4, 5, 6, 7. The novel antenna system also features low side lobes for all sensitivity patterns, low loss, and very low volume with maximum ruggedness and reliability.

While the invention has been described in its preferred embodiments, it is to be understood that the words which have been used are words of description rather than of limitation and that changes within the purview of the appended claims may be made without departure from the true scope and spirit of the invention in its broader aspects.

What is claimed is:

1. Apparatus having focal properties for the collimation and transfer of high frequency electromagnetic energy comprising:

spaced electrically conducting planar broad wall means forming symmetric truncated triangular energy propagation means having first and second opposed energy exchanging port means and characterized by an axis of mirror symmetry, cylindric dielectric lens means adjacent said first port means disposed within said energy propagation means, said cylindric dielectric lens means having a substantially planar surface at said first port means, said cylindric dielectric lens means further having a convex substantially hyperbolic surface symmetrically disposed within said energy propagation means, first plural wave guide coupling means at said first port means in energy exchanging relation with said planar surface of said cylindric dielectric lens means, and second plural wave guide coupling means at said second port means in energy exchanging relation therewith.

2. Apparatus as described in claim 1 wherein said second plural wave guide coupling means comprises a plurality of symmetrically disposed hollow wave guide horn means each having an axis of directivity intersecting said axis of mirror symmetry and said further substantially hyperbolic surface.

3. Apparatus as described in claim 2 wherein said first plural wave guide coupling means cooperates with a plurality of individual slotted wave guide means each coupled to a corresponding one of said wave guide coupling means, whereby said slotted guide means cooperatively form antenna array means.

4. Apparatus as described in claim 3 wherein said first plural wave guide coupling means comprises a plurality of adjoined wave guide 180° bend means and wave guide 90° twist means each for exchanging energy between said respective slotted wave guide means and said planar surface of said cylindric lens means.

5. Apparatus as described in claim 2 further including:

signal detector means coupled to said respective hollow wave guide horn means, and means for utilizing the respective individual outputs of said signal detector means.

6. Apparatus as described in claim 4 wherein said plurality of individual slotted wave guide means is disposed cooperatively side-by-side in cooperative relation for forming planar slotted antenna array means for the directive exchange of electromagnetic energy with respect to remote objects.

7. Apparatus as described in claim 6 wherein the plane of said slotted array means is substantially parallel to the planes of said planar broad wall means.

8. Apparatus as described in claim 1 wherein the focal length-to-maximum dimension ratio of said cylindric dielectric lens means is substantially 0.5.

9. Apparatus as described in claim 1 wherein said cylindrical dielectric lens means is characterized by:

t = a maximum thickness,

F = a focal distance of the lens focal point with respect to the locus of said maximum thickness at said substantially hyperbolic surface, $N_e$ = an index of refraction for microwave energy within an air filled portion of said symmetric truncated triangular energy propagation means, $N_f$ = an index of refraction for microwave energy within the portion of said symmetric truncated triangular energy propagation means occupied by said cylindric dielectric lens means, and D = a maximum dimension of said cylindric dielectric lens means, whereby said maximum thickness t is defined by the relation:

$$(N_f^2-N_e^2)t^2+2F(N_eN_f-N_e^2)t-((D/2)N_e)^2=0$$

10. Apparatus as described in claim 9 wherein said cylindric dielectric lens means is further characterized by a substantially hyperbolic surface.

* * * * *